US007069993B2

(12) United States Patent
Hill

(10) Patent No.: US 7,069,993 B2
(45) Date of Patent: Jul. 4, 2006

(54) DOWN HOLE OIL AND GAS WELL HEATING SYSTEM AND METHOD FOR DOWN HOLE HEATING OF OIL AND GAS WELLS

(76) Inventor: William L. Hill, P.O. Box 3112, Longview, TX (US) 75606

( * ) Notice: Subject to any disclaimer, the term of this patent is extended or adjusted under 35 U.S.C. 154(b) by 59 days.

(21) Appl. No.: 10/763,568

(22) Filed: Jan. 23, 2004

(65) Prior Publication Data

US 2004/0216881 A1 Nov. 4, 2004

Related U.S. Application Data

(63) Continuation-in-part of application No. 10/037,754, filed on Oct. 22, 2001, now Pat. No. 6,681,859.

(51) Int. Cl.
*E21B 36/04* (2006.01)

(52) U.S. Cl. ..... 166/302; 166/248

(58) Field of Classification Search ..... 166/248, 166/272.1, 302

See application file for complete search history.

(56) References Cited

U.S. PATENT DOCUMENTS

| | | | | |
|---|---|---|---|---|
| 522,737 | A | | 7/1894 | Lucock |
| 782,233 | A | | 2/1905 | Gardner |
| 806,039 | A | | 11/1905 | Williamson |
| 972,308 | A | | 10/1910 | Williamson |
| 1,140,982 | A | | 5/1915 | Huff |
| 1,368,404 | A | | 2/1921 | Loftus |
| 1,450,658 | A | | 4/1923 | Warnick |
| 1,690,994 | A | | 11/1928 | Powell |
| 2,757,738 | A | | 8/1956 | Ritchey |
| 3,137,347 | A | | 6/1964 | Parker |
| 3,220,479 | A | | 11/1965 | Ortloff et al. |
| 3,379,256 | A | | 4/1968 | Alexander et al. |
| 3,857,776 | A | * | 12/1974 | Titus et al. ..... 204/290.07 |
| 4,415,034 | A | * | 11/1983 | Bouck ..... 166/302 |
| 4,570,715 | A | | 2/1986 | Van Meurs |
| 4,694,907 | A | | 9/1987 | Stahl |
| 4,988,389 | A | | 1/1991 | Adamache |
| 5,060,287 | A | * | 10/1991 | Van Egmond ..... 392/301 |
| 5,120,935 | A | | 6/1992 | Nenniger |
| 5,247,994 | A | | 9/1993 | Nenniger |
| 5,282,508 | A | * | 2/1994 | Ellingsen et al. ..... 166/249 |
| 5,361,845 | A | | 11/1994 | Jamaluddin |
| 5,433,271 | A | | 7/1995 | Vinegar et al. |
| 5,517,593 | A | | 5/1996 | Nenniger |
| 5,621,844 | A | | 4/1997 | Bridges |
| 5,713,415 | A | | 2/1998 | Bridges |
| RE35,891 | E | | 9/1998 | Jamaluddin et al. |
| 6,269,876 | B1 | * | 8/2001 | De Rouffignac et al. ..... 166/60 |
| 6,353,706 | B1 | | 3/2002 | Bridges |

* cited by examiner

*Primary Examiner*—Frank S. Tsay
(74) *Attorney, Agent, or Firm*—Cox Smith Matthews Incorporated

(57) ABSTRACT

A down hole heating system for use with oil and gas wells which exhibit less than optimally achievable flow rates because of high oil viscosity and/or blockage by paraffin (or similar meltable petroleum byproducts). The heating unit the present invention includes shielding to prevent physical damage and shortages to electrical connections within the heating unit while down hole (a previously unrecognized source of system failures in prior art systems). The over-all heating system also includes heat retaining components to focus and contain heat in the production zone to promote flow to, and not just within, the production tubing.

7 Claims, 2 Drawing Sheets

DOWN HOLE OIL AND GAS WELL HEATING SYSTEM AND METHOD FOR DOWN HOLE HEATING OF OIL AND GAS WELLS

CITATION TO PRIOR APPLICATION

This is a continuation-in-part with respect to U.S. patent application Ser. No. 10/037,754 filed Oct. 22, 2001 now U.S. Pat. No. 6,681,859.

BACKGROUND OF THE INVENTION

1. Field of the Invention

The present invention relates to systems and methods for producing or delivering heat at or near the down hole end of production tubing of a producing oil or gas well for improving production therefrom.

2. Background Information

Free-flowing oil is increasingly difficult to find, even in oil wells that once had very good flow. In some cases, good flowing wells simply "clog up" with paraffin. In other cases, the oil itself in a given formation is of a viscosity that it simply will not flow (or will flow very slowly) under naturally ambient temperatures.

Because the viscosity of oil and paraffin have an inverse relationship to their temperatures, the solution to non-flowing or slow flowing oil wells would seem fairly straight forward—somehow heat and oil and/or paraffin. However, effectively achieving this objective has proven elusive for many years.

In the context of gas wells, another phenomena—the buildup of iron oxides and other residues that can obstruct the free flow of gas through the perforations, through the tubing, or both—creates a need for effective down hole heating.

Down hole heating systems or components for oil and gas wells are known (hereafter, for the sake of brevity, most wells will simply be referred to as "oil wells" with the understanding that certain applications will apply equally well to gas wells). In addition, certain treatments (including "hot oil treatments") for unclogging no-flow or slow-flow oil wells have long been in use. For a variety of reasons, the existing technologies are very much lacking in efficacy and/or long-term reliability.

The present invention addresses two primary shortcomings that the inventor has found in conventional approaches to heating oil and paraffin down hole: (1) the heat is not properly focused where it needs to be; and (2) existing down hole heaters fail for lack of design elements which would protect electrical components from chemical or physical attack while in position.

The present inventor has discovered that existing down hole heaters inevitably fail because their designers do not take into consideration the intense pressures to which the units will be exposed when installed. Such pressure will force liquids (including highly conducive salt water) past the casings of conventional heating units and cause electrical shorts and corrosion. Designers with whom the present inventor has discussed heater failures have uniformly failed to recognize the root cause of the problem—lack of adequate protection for the heating elements and their electrical connections. The down hole heating unit of the present invention addresses this shortcoming of conventional heating units.

Research into the present design also reveals that designers of existing heaters and installations have overlooked crucial features of any effective down hole heater system: (1) it must focus heat in such a way that the production zone of the formation itself is heated; and (2) heat (and with it, effectiveness) must not be lost for failure to insulate heating elements from up hole components which will "draw" heat away from the crucial zones by conduction.

However subtle the distinctions between the present design and those of the prior art might at first appear, actual field applications of the present down hole heating system have yielded oil well flow rate increases which are multiples of those realized through use of presently available down hole heating systems. The monetary motivations for solving slow-flow or no-flow oil well conditions are such that, if modifying existing heating units to achieve the present design were obvious, producers would not have spent millions of dollars on ineffective down hole treatments and heating systems (which they have done), nor lost millions of dollars in production for lack of the solutions to long-felt problems that the present invention provides (which they have also done)

SUMMARY OF THE INVENTION

It is an object of the present invention to provide an improved down hole heating system for use in conditioning oil and gas wells for increased flow, when such flow is impeded because of viscosity and/or paraffin blockage conditions.

It is another object of the present invention to provide an improved design for down hole heating systems which has the effect of more effectively focusing heat where it is most efficacious in improving oil or gas flow in circumstances when such flow is impeded because of oil viscosity and/or paraffin blockage conditions.

It is another object of the present invention to provide an improved design for down hole heating systems for oil and gas wells which design renders the heating unit useful for extended periods of time without interruption for costly repairs because of damage or electrical shorting caused by unit invasion by down hole fluids.

It is another object of the present invention to provide an improved method for down hole heating of oil and gas wells for increasing flow, when such flow is impeded because of viscosity and/or paraffin blockage conditions.

In satisfaction of these and related objects, the present invention provides a down hole heating system for use with oil and gas wells which exhibit less than optimally achievable flow rates because of high oil viscosity and/or blockage by paraffin (or similar meltable petroleum byproducts). The system of the present invention, and the method of use thereof, provides two primary benefits: (1) the involved heating unit is designed to overcome an unrecognized problem which leads to frequent failure of prior art heating units—unit invasion by down hole heating units with resulting physical damage and/or electrical shortages; and (2) the system is designed to focus and contain heat in the production zone to promote flow to, and not just within, the production tubing.

DETAILED DESCRIPTION OF THE PREFERRED EMBODIMENT

Figure 1:
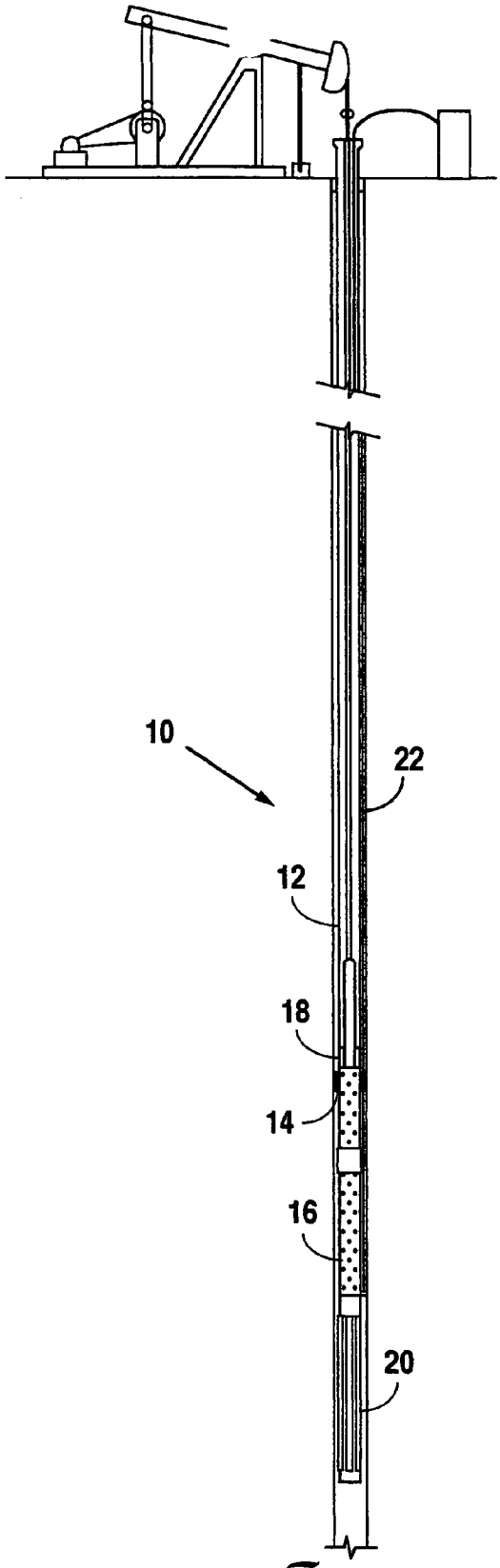
FIG. 1 is an elevational view of a producing oil well with the components of the present down hole heating system installed.

Referring to FIG. 1, the complete down hole heating system of the present invention is generally identified by the reference numeral 10. System 10 includes production tubing 12 (the length of which depends, of course, on the depth of the well), a heat insulating packer 14, perforated tubing 16, a stainless steel tubing collar 18, and a heating unit 20.

Heat insulating packer 14 and stainless steel collars 18 are included in their stated form for "containing" the heat from heating unit 20 within the desired zone to the greatest practical degree. Were it not for these components, the heat from heating unit 20 would (like the heat from conventional down hole heater units) convect and conduct upward in the well bore and through the production tubing, thereby essentially directing much of the heat away from the area which it is most needed—the production zone.

Perhaps, it goes without saying that oil that never reaches the pump will never be produced. However, this truism seems to have escaped designers of previous down-hole heating schemes, the use of which essentially heats oil only as it enters the production tubing, without effectively heating it so that it will reach the production tubing in the first place. largely containing the heat below the level of the junction between the production tubing 12 and the perforated tubing 16, as is achieved through the current design, has the effect of focusing the heat on the production formation itself. This, in turn, heats oil and paraffin in situ and allows it to flow to the well bore for pumping, thus "producing firs the viscous materials which are impeding flow," and then the desired product of the well (oil or gas). Stainless steel is chosen as the material for the juncture collars at and below the joinder of production tubing 12 and perforate tubing 16 because of its limited heat conductive properties.

Physical and chemical attack of the electrical connections between the power leads and the heater rods of conventional heating systems, as well as shorting of electrical circuits because of invasion of heater units by conductive fluids is another problem of the present art to which the present invention is addressed.

The patent application which serves as a priority basis for the present invention discloses an embodiment that tremendously increases down hole wiring connection integrity. However, referring to FIG. 2, the present invention is even better at preventing the aforementioned electrical problems. In fact, the unique combination of the materials, particularly ceramic cement, a highly durable insulation means, and the use of connector pins, provides protection against shortage and other connection damage not previously possible. Such an improvement is of great significance as the internal connection for a down hole heating unit must be impenetrably shielded from the pressures and hostile chemical agents that surround the unit in the well bore.

Figure 2:
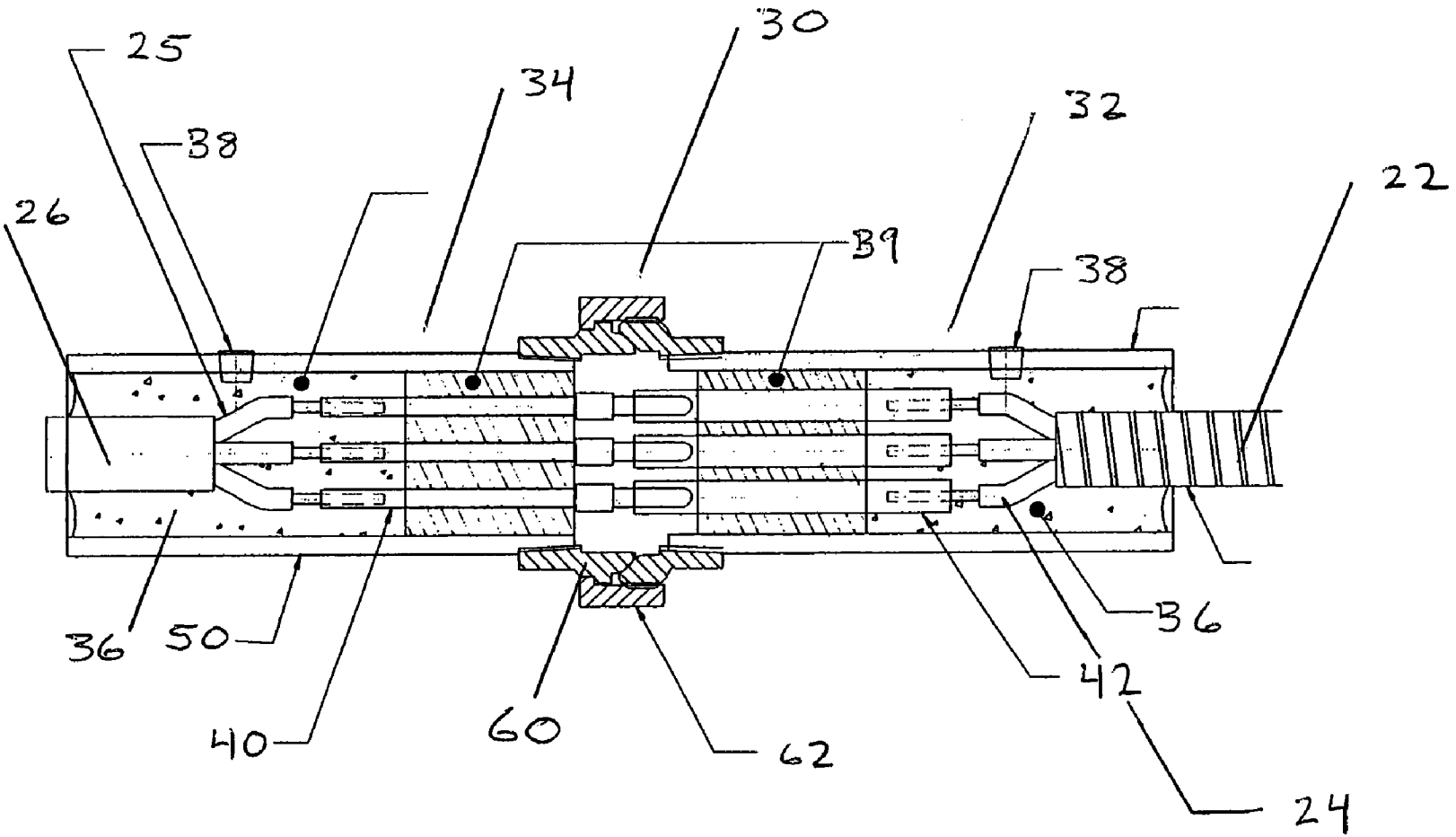
FIG. 2 is an elevational, sagittal cross section view of the heating unit connector of the present invention.

Referring in combination to FIGS. 1 and 2, heating unit 20 includes heating unit connector 30. Heating unit connector 30 is responsible for ensuring the integrity of the connection between surface wiring leads 24 and heater rod wiring leads 25. The electrical current for heater rod 26 is supplied by cables 22, which run down the exterior of production tubing 12 and connect to surface wiring leads 24 at the upper end of heating unit 20.

As shown in FIG. 2, heating unit connector 30 is comprised of two substantially identical pieces. The upper piece, generally referred to by numeral 32, houses surface wiring leads 24. The lower piece, generally referred to by numeral 34, houses heater wiring 26.

Heater unit connector 30 also contains two connector pins (male and female), where each connector pin has a distal and a medial end. The union between male connector pin 40 and female connector pin 42 takes place at the medial end of each connector piece, or at the center-most portion of heater unit connector 30. Male connector pin 40, at its distal end, has a female receptacle that receives a male connection from heater wiring leads 25. At its medial end, male connector pin 40 has a male extension that is plugged into the medial end of female connector pin 42.

Female connector pin 42 contains female receptacles at both its medial and distal end. At its distal end, female connector pin 42 receives a male connection from surface wiring leads 24. At its medial end, female connector pin 42 receives male connector pin 40. Importantly, the improvements provided by the present invention do not depend on any specific connector pin configuration. In fact, as will become apparent to those skilled in the art, different connector pin configurations or different connector pin types may work equally as well.

Connector pieces 32 and 34 each contain, in their distal portion, a high temperature ceramic cement filled region, generally designated by numeral 36. The ceramic cement of region 36 serves to enclose the junction between each connector pin and the respective wiring of each piece. In the preferred embodiment, the high temperature ceramic cement is an epoxy material which is available as Sauereisen Cement #1, which may be obtained from the Industrial Engineering and Equipment Company ("Indeeco") of St. Louis, Mo., USA.) However, as will become apparent to those skilled in the art, other materials may serve to perform the desired function.

Upon drying, the high temperature ceramic cement of region 36 becomes an essentially glass-like substance. Shrinkage is associated with the cement as it dries. As such, in the preferred embodiment, each heater unit connector piece contains a pipe plug 38. Pipe plug 38 provides an access point through which additional ceramic cement can be injected into each piece, thereby filling any void which develops as the ceramic cement dries. Further, pipe plug 38 may be reversibly sealed to each piece so that epoxy can be injected as needed while the strength of the seal is maintained.

Connector pieces 32 and 34 further contain, in the medial portion, an insulator block region, generally designated by numeral 39. Insulator region 39 houses each connector pin so that the union between male connector pin 40 and female connector pin 42 is suitably insulated from any outside chemical or electrical agent.

In order to withstand the corrosive chemicals and enormous external pressure, the outer surface of heater unit connector 30 must be incredibly strong. The aforementioned elements of connector 30 are encased in a steel fitting assembly 50 ("encasement means"), each component of which is welded with continuous beads, using the "TEG" welding process, to each adjoining component. In the preferred embodiment, the outer surface of connector 30 is comprised of stainless steel, which is joined using the process of "TEG" welding. This welding process allows the seams of joined components to withstand the extreme conditions of the bore well.

Finally, each connector piece is secured to the other by fitting assembly 60. Fitting assembly 60 and sealing fitting 62 are, as would be apparent to anyone skilled in the art, designed to engage one another so as to form a sealed junction. In the preferred embodiment, this union is a standard two inch union that is modified by "TEG" welding.

That is, the union is welded using the TEG process so that it will withstand the extreme environmental conditions of the bore well.

The shielding of the electrical connections between surface wiring leads 24 and heater wiring leads 25 is crucial for long-term operation of a down hole heating system of the present invention. Equally important is that power is reliably delivered to that connection. Therefore, solid copper leads with KAPTON insulation are used, such leads being of a suitable gauge for carrying the intended 16.5 Kilowatt, 480 volt current for the present system with its 0.475 inch diameter INCOLOY heater rods 26 (also available from Indeeco).

The present invention includes the method for use of the above-described system for heat treating an oil or gas well for improving well flow. the method would be one which included use of a down hole heating unit with suitably shielded electrical connections substantially as described, along with installation of the heat-retaining elements also as described to properly focus heat on the producing formation.

In addition to the foregoing, it should be understood that the present method may also be utilized by substituting cable ("wire line") for the down hole pipe for supporting the heating unit 20 while pipe is pulled from the well bore. In other words, one can heat-treat a well using the presently disclosed apparatuses and their equivalents before re-inserting pipe, such as during other well treatments or maintenance during which pipe is pulled. It is believed that this approach would be particularly beneficial in treating deep gas wells with iron sulfide occlusion problems.

Although the invention has been described with reference to specific embodiments, this description is not meant to be construed in a limited sense. Various modifications of the disclosed embodiments, as well as alternative embodiments of the inventions will become apparent to persons skilled in the art upon reference to the description of the invention. It is, therefore, contemplated that the appended claims will cover such modifications that fall within the scope of the invention.

I claim:

1. An apparatus for heating a segment of oil and gas well bores and surrounding strata comprising:

an electrical resistance heating rod;

electrical cable for carrying electrical current from an electrical current source outside of the well bore to said electrical resistance heating rod when positioned inside of said well bore;

a protective block in which is embedded a first and second connector pin, where said first pin joins said electrical cable to said second pin and said second pin joins said heating rod to said first pin, said protective block being constructed of a moldable material which, when cured, is substantially impervious to pressure and chemical permeation and oil and gas well bore bottom pressures and environments;

a metallic encasement member encasing said protective block and sealably welded to form a substantially impervious enclosure with said block and said embedded portion of said heating rod and said electrical cable therein, except that said metallic encasement admits said electrical cable and said heating rod there into for attachment;

a perforated production tubing segment, a proximal perforated production tubing segment end of which is reversibly engageable to a distal terminus of oil or gas well production tubing string and a distal perforated production tubing segment end of which is engageable with said metallic encasement member; and a heating rod support frame which extends from said metallic encasement means opposite its engagement with said perforated production tubing segment and in which a portion of said heating rod is supported.

2. The apparatus of claim 1 wherein said protective block is further comprised of an insulated portion that encloses the connection between said first pin and said second pin.

3. The apparatus of claim 2 where said metallic encasement member contains a reversibly sealable aperture through which said moldable material may be repeatedly injected to said block to ensure the absence of any void.

4. The apparatus of claim 3 where said metallic encasement member is welded together using the "TEG" welding process so as to impart extraordinary strength to said metallic encasement member.

5. The apparatus of claim 1 where said metallic encasement member contains a reversibly sealable aperture through which said moldable material may be repeatedly injected to said block to ensure the absence of any void.

6. The apparatus of claim 5 where said metallic encasement member is welded together using the "TEG" welding process so as to impart extraordinary strength to said metallic encasement member.

7. The apparatus of claim 1 where said metallic encasement member is welded together using the "TEG" welding process so as to impart extraordinary strength to said metallic encasement member.

* * * * *